US005446258A

United States Patent [19]

Mordike

[11] Patent Number: 5,446,258

[45] Date of Patent: Aug. 29, 1995

[54] PROCESS FOR REMELTING METAL SURFACES USING A LASER

[75] Inventor: Barry L. Mordike, Osterode-Dorste, Germany

[73] Assignee: MLI Lasers, Tel Aviv, Israel

[21] Appl. No.: 119,160

[22] PCT Filed: Apr. 7, 1992

[86] PCT No.: PCT/DE92/00295

§ 371 Date: Sep. 24, 1993

§ 102(e) Date: Sep. 24, 1993

[87] PCT Pub. No.: WO92/18653

PCT Pub. Date: Oct. 29, 1992

[30] Foreign Application Priority Data

Apr. 12, 1991 [DE] Germany ..... 41 11 989.4

[51] Int. Cl.[6] ..... B23K 26/00; B23K 26/08

[52] U.S. Cl. ..... 219/121.66; 219/121.61; 219/121.73; 219/121.92; 148/565; 148/512

[58] Field of Search ..... 219/121.65, 121.66, 219/121.61, 121.82, 121.73, 121.74, 121.75; 148/512, 565, 903; 74/567

[56] References Cited

U.S. PATENT DOCUMENTS 4,304,978 12/1981 Saunders .
4,686,349 8/1987 Kawazu et al. ..... 219/121.65
4,692,583 9/1987 Kimura et al. .
4,714,809 12/1987 Hammond et al. .

FOREIGN PATENT DOCUMENTS 0213471 3/1987 European Pat. Off. .
2940127 4/1980 Germany .
3910280 10/1990 Germany .
3916684 11/1990 Germany .
56-112415 9/1981 Japan .
63-89624 4/1988 Japan ..... 148/512
63-134634 6/1988 Japan .
63-293118 11/1988 Japan ..... 148/512

OTHER PUBLICATIONS

Zechmeister et al., "Bearbeitung mit Hochleistungslasern", Werkstatt und Betrieb, vol. 115:265–267, (1982).

*Primary Examiner*—Bruce A. Reynolds
*Assistant Examiner*—Gregory L. Mills
*Attorney, Agent, or Firm*—Foley & Lardner

[57] ABSTRACT

A process for remelting metal surfaces, in particular, camshafts, using a laser. The invention shortens the cycle times and further increases cost-effectiveness by not requiring remelting in a plurality of steps. The process uses a laser beam which is focused to a rectangle. The length of the beam spot extends over the entire width of the workpiece surface of the cam. The power density and relative speed are set in order to achieve the desired remelting depth.

9 Claims, 1 Drawing Sheet

PROCESS FOR REMELTING METAL SURFACES USING A LASER

BACKGROUND OF THE INVENTION

The invention relates to a process for remelting metal surfaces using a laser to increase the wear resistance of metal surfaces. This is of particular importance in the case of camshafts which are used for the valve timing gear in internal-combustion engines. Due to their rotary movement, the individual cams arranged on the camshaft effect an adjustment of the corresponding cam followers, valve levers or the like. Normally, the wear resistance of the cam running surfaces is increased by remelting. It has already been known for a relatively long time to make use of the so-called TIG process (tungsten inert gas process) for this purpose. A particular disadvantage of this process is, the relatively high time outlay and the long cycle times bound up therewith. German Publication DE 3,916,684 A1 discloses using a rectangular laser beam to carry out remelting of valve lever running surfaces for the valve timing gear of internal-combustion engines. The width of the surfaces to be remelted is subdivided there into a plurality of subregions and a large middle top region is remelted separately in time from outer edge regions. Here, too, the time outlay is still relatively high.

SUMMARY OF THE INVENTION

It is an object of the present invention to provide a particularly cost-effective process for remelting by using a laser. The invention provides a process for remelting metal cam running surfaces on a cast iron cam using a laser beam focused to a rectangle. A laser beam is produced which has a rectangle length substantially equal to a width of a cam running surface and a rectangle width between approximately 1 to 3 mm. The laser beam is applied to the cam running surface. The laser beam is controlled such that immediately above the cam running surface the laser beam has a power density between $5\times10^4$ and $1\times10^5$ W/cm$^2$. Relative movement is effected between the cam running surface and the laser beam approximately transversely to the laser beam at a speed of 2 to 6.5 cm/sec.

BRIEF DESCRIPTION OF THE DRAWINGS

The invention will be described in further detail below with reference to the accompanying FIGURE, which illustrates a preferred embodiment of the invention.

DETAILED DESCRIPTION OF THE INVENTION

Figure 1:
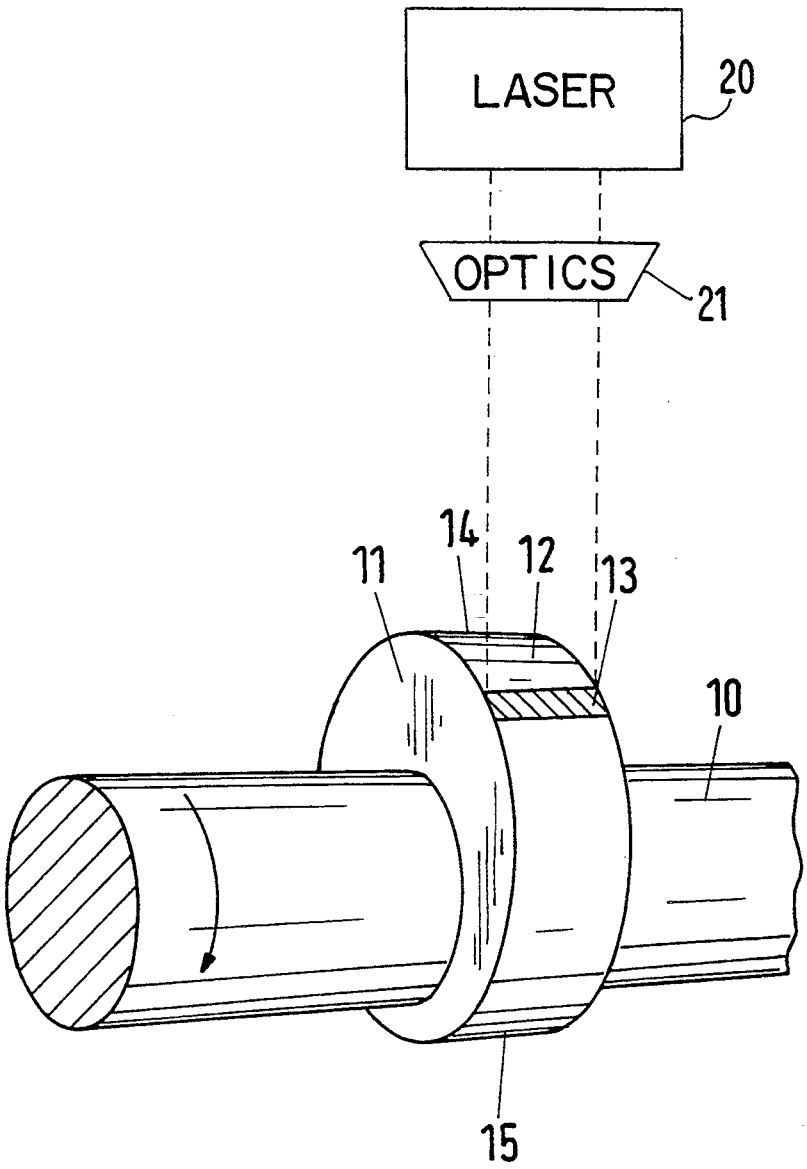

It has been proved that given a specific parameter setting it is possible to remelt the entire surface width of a workpiece in one operation without the occurrence of undesired phenomena at the surface edge regions. Correspondingly, in the process according to the invention the length of the laser beam rectangle is set approximately as wide as the width of the workpiece surface, that is a rectangle width of approximately 1 to 3 mm. Immediately above the metal surface, a laser beam with a power density of $5\times10^4$ to $1\times10^5$ W/cm$^2$ is provided. The metal surface moves relatively and approximately transversely to the laser beam at a speed of 2 to 6.5 cm/sec, preferably 4 to 4.5 cm/sec. It is possible to achieve particularly wear-resistant surfaces by means of the process of this invention in a cost-effective way and with a relatively short machining time.

Before remelting using the laser, the workpiece, in particular the camshaft, having the metal surface, is advantageously preheated to 360° to 420° C., preferably to approximately 400° C. The remelting time is further reduced thereby, and the wear resistance is improved overall after termination of the process.

The quality of the surface edge regions corresponds strongly to the remelting depth. Remelting the surface down to a depth of 350 μm is particularly advantageous. Further added to this dimension is a tolerance of preferably 200 μm for grinding of the surface which may optionally be carried out after the remelting.

An example of the process according to the invention is explained in more detail below with the aid of the sole FIGURE. The FIGURE shows a laser 20 and one cam 11 of a plurality of cams which are arranged on a camshaft 10. The running surface of the cam is denoted by the numeral 12. For the purpose of remelting, a laser beam is focused via an optical system (21) to a rectangle 13 directed onto the running surface 12. Said rectangle is shown hatched purely for the purpose of a better understanding. The camshaft 10 is rotated in order to remelt the entire running surface. Because of the noncircular shape of the cam 11, the distance of the optical system from the camshaft 10 can be adjusted, thus resulting in a distance from the running surface 12 which remains constant or can be set in a controlled fashion. In this way, a settable power density of approximately $5\times10^4$ to $1\times10^5$ W/cm$^2$ is ensured in the region of the rectangle 13 and of the cam 11 passing through thereunder. The length of the rectangle 13 corresponds to the width of the running surface 12. The width of the rectangle 13 is approximately 1 to 3 mm. The camshaft 10 rotates at a specific speed for the purpose of remelting. A speed of 2 to 6.5 cm/sec, preferably 4 to 4.5 cm/sec, is produced on the running surface 12 relative to the rectangle 13 of the laser beam.

In a further embodiment, although the speed of the metal surface relative to the laser beam is in the region specified above, the camshaft 10 does not rotate uniformly, but at different angular velocities in sections, depending on the cam shape. The noncircular shape of the cam 11 causes a poorer dissipation of heat in the region of the cam tip 14 and the adjacent regions of the running surface, because here the surfaces to be remelted are located closer to one another than, for example, at the blunt end 15. A variation in the rotational speed of the camshaft is therefore required in order to achieve a desired remelting depth of approximately 350 μm.

The camshaft 10 is preheated to approximately 400° C. before the actual remelting operation. There is no need for a particularly controlled cooling operation after the remelting. A quenching effect is produced purely by the dissipation of heat from the running surface 12 in the direction of the camshaft 10.

Since the running surfaces 12 are ground after the remelting, this is to be taken into account when setting the remelting depth via the rotational speed of the camshaft 10, and, as the case may be, the power density of the laser beam. Since at most 200 μm is ground off, a remelting depth of 550 μm is to be set.

The camshaft 10 consists of cast iron. The abovementioned parameters apply, in particular, to cast iron having the designation of GG 25 to GG 30.

LIST OF REFERENCE NUMERALS

10—Camshaft
11—Cam
12—Running surface
13—Rectangle
14—Cam tip
15—Blunt end
20—Laser
21—Focusing optics

What I claim is:

1. A process for remelting metal cam running surfaces on a cast iron cam using a laser beam focused to a rectangle, comprising the steps of:

(a) producing a laser beam having a rectangle length substantially equal to a width of a cam running surface and a rectangle width of approximately 1 to 3 mm and applying the laser beam to the cam running surface;

(b) controlling the laser beam such that immediately above the cam running surface the laser beam has a power density of approximately $5\times10^4$ to $1\times10^5$ W/cm$^2$; and (c) effecting relative movement between the cam running surface and the laser beam approximately transversely to the laser beam at a speed of approximately 2 to 6.5 cm/sec.

2. A process according to claim 1, wherein the cam running surface moves relative to the laser beam at a speed of 4 to 4.5 cm/sec.

3. A process according to claim 1, further comprising preheating the cam to 360° to 420° C.

4. A process according to claim 1, wherein the cam running surface is remelted down to a depth of approximately 350 m.

5. A process according to claim 2, further comprising preheating the cam to 360° to 420° C.

6. A process according to claim 2, wherein the cam running surface is remelted down to a depth of approximately 350 μm.

7. A process according to claim 3, wherein the cam running surface is remelted down to a depth of approximately 350 μm.

8. A process according to claim 1, further comprising preheating the cam to approximately 400° C.

9. A process according to claim 2, further comprising preheating the cam to approximately 400° C.

* * * * *